US006589595B2

(12) United States Patent
Kinnaird

(10) Patent No.: US 6,589,595 B2
(45) Date of Patent: Jul. 8, 2003

(54) METHOD AND APPARATUS FOR PREVENTING ASPHALT FROM STICKING TO PAVING EQUIPMENT

(75) Inventor: Michael Gates Kinnaird, Durham, NC (US)

(73) Assignee: Chemtek, Inc., Yanceyville, NC (US)

( * ) Notice: Subject to any disclaimer, the term of this patent is extended or adjusted under 35 U.S.C. 154(b) by 0 days.

(21) Appl. No.: 09/833,838

(22) Filed: Apr. 13, 2001

(65) Prior Publication Data

US 2002/0150676 A1 Oct. 17, 2002

(51) Int. Cl.[7] ..... B05D 1/02; B05D 7/14

(52) U.S. Cl. ..... 427/154; 427/156; 427/421; 427/426; 118/699; 118/706; 239/87; 239/99; 239/398; 239/407

(58) Field of Search ..... 427/421, 426, 427/154, 156; 118/699, 700; 239/87, 99, 398, 407

(56) References Cited

U.S. PATENT DOCUMENTS 3,726,293 A * 4/1973 Padek ..... 134/172
4,609,575 A * 9/1986 Burkman ..... 118/326
5,888,279 A * 3/1999 Salmonsen et al. ..... 106/2

* cited by examiner

*Primary Examiner*—Shrive P. Beck
*Assistant Examiner*—Jennifer Kolb Michener

(57) ABSTRACT

A method of preventing tar, asphalt and related material from sticking to paving equipment involves spraying a release agent concentrate diluted with water contemporaneously with spraying, utilizing a carbonator pump capable of about 1 gallon per minute pumping rate at about 200 psi, an appropriately-sized motor, a pushbutton momentary contact switch, a timing relay capable of switching the motor on and running it for about 1–2 minutes, a spray gun and appropriately-sized nozzle, appropriate fittings and hoses, and such optional ancillary devices as solenoid valves, particulate screens and freeze protection. The major advantages of the instant invention are that it is simple and economical to build, very robust, and is capable of delivering a good spray pattern at relatively high concentrations of viscous release agents.

5 Claims, 1 Drawing Sheet

METHOD AND APPARATUS FOR PREVENTING ASPHALT FROM STICKING TO PAVING EQUIPMENT

BACKGROUND OF THE INVENTION

1. Field of the Invention

This invention relates to a method of preventing asphalt from sticking to paving equipment, utilizing a device that will apply a release coating to paving equipment surfaces, said coating is a diluted mixture of a viscous concentrate, and said coating is a viscous solution. The method comprises:

1) coating a paving equipment surface by spraying, rolling or brushing with a release agent,
2) adding or contacting tar or asphalt to the equipment or otherwise handling or using the asphalt with the sprayed equipment, and
3) separating the asphalt from the equipment by releasing it at its point of intended use or
4) otherwise releasing the tar or asphalt from the paving equipment.

The method utilizes a piece of equipment that makes it possible to spray on highly-viscous dilutions of highly-active asphalt release agents. The device consists essentially of:

1) a carbonator pump or other vaned, positive-displacement pump which produces a minimum flow of about one gallon per minute ("1 GPM") and 200–300 pounds per square inch ("psi") pressure; and associated electric motor to drive the pump,
2) a timer relay to control the pump and motor,
3) an induction/injection valve with a high induction capacity resulting in a dilution ratio of to concentrate as low as about a 10/1 dilution ratio, even with viscous concentrates,
4) a spray gun with an appropriately-sized nozzle, (or a spray bar and a multiplicity of nozzles) and
5) necessary tubing, fittings, connections, control buttons, a box to enclose the apparatus, as well as a pressure relief valve and/or bypass valve, freeze protection, a particulate-filtering screen or screens, a solenoid to prevent non-pumped release of the release coating as optional ancillary devices.

The singular advantages of the instant invention are that the system utilizes only one pump, the components are very durable, so the system is therefore robust, and the system is able to deliver effective sprays of highly-viscous release coatings, in the right and adjustable dilution ratio, and from viscous concentrates.

2. Prior Art 2.1. General Considerations

It is well-known in the industry that tar and asphalt, used in their molten or liquid state, have a strong tendency to adhere to surfaces of the equipment used to handle, transport and otherwise use them. This buildup can be severe, rendering the equipment completely unsuitable for its purpose.

One traditional way to address this problem has been to spray the equipment with diesel fuel, which forms a lubricating layer in between the asphalt and the equipment. However, for regulatory and other reasons, this has become an obsolete method.

2.2. Examples of Prior and/or Related Art

One response to the regulatory pressure to stop using diesel fuel has been to use other, less environmentallyunacceptable alternative solvents. An example of this type is "004", a citrus-based solvent sold by the Zep Company. It is used to clean paving equipment and to prevent tar or asphalt from sticking to the equipment in the first place. This type of solvent suffers from several drawbacks, at least one of which is the increased cost compared to diesel fuel.

Another drawback to this approach is that frequently the solvents chosen have a detrimental effect on the asphalt or tar in its final location, leading to a decreased strength of the resultant surface. For this reason, most such solvents can not be approved by state departments of transportation (DOT) for use as truck bed release agents, and so cannot be used on truck beds that are carrying asphalt to pave on state roads.

Typically, the tests are rather severe, for instance allowing contact between asphalt and solvent for 24 hours, and determining if there is any discoloration whatsoever in the solvent mixture. Most solvents used for release agents are unable to pass such a test.

Another response has been to utilize water-dilutable formulations. The major solvent in this situation is water, which is cheap and plentiful, and known to repel asphalt. However, many of these materials suffer from serious drawbacks, leading to a reputation in the industry that they are ineffective. The major drawback with such poorly-performing formulations is that they are mostly water to begin with, and the resultant highly-dilute water film is insufficiently persistent.

Other water-dilutable formulations, such as LiquiSlip by the Dubois Corporation utilize a combination of these two methods. The concentrate contains a petroleum solvent and emulsifiers, and a special machine combines the concentrate with water to form a creamy emulsion, which the apparatus sprays on the surfaces to be release coated, and the coating acts to prevent asphalt from sticking. The major problems associated with this approach are that it involves petroleum-based solvents, and that two pumps and a specialized delivery system are required to make it work.

The petroleum solvent in the product makes it unacceptable to accidentally spray it on the ground. The emulsified product is highly-viscous when diluted, and so spraying it requires two pumps, one to pump the concentrate, and another to pump the diluted mixture. This approach can be undesirable, moreover, due to the increased costs associated with utilizing two pumps, both in terms of initial capital, and in terms of difficulty, frequence and cost of maintenance, balancing the outputs of the two pumps, etc.

A formulation recently patented by Chemtek, Inc., is the subject of U.S. Pat. No. 6,126,757. This formulation comprises primarily fatty acids neutralized by organic nitrogenous bases, and fatty acid amides. The formulation is rather viscous, and the resulting dilutions are very viscous.

No device currently known to be on the market is able to adequately and inexpensively deliver dilutions of these formulations, and so a special device was required. It is the object of this invention to provide such a device, to be able to utilize the above-mentioned formulation. This device utilizes only one pump, and so minimizes the expense and difficulty associated with the products' delivery.

SUMMARY

An object of the present invention is to provide a method to prevent tar or asphalt from sticking to paving equipment, but without resorting to using solvents that may attack the asphalt. Another object of the present invention is to provide a method of utilizing water as a diluent, a cheap, plentiful diluent that also repels asphalt. It is another object of the present invention to provide a method to protect equipment from getting tar or asphalt stuck to them without resort to petroleum-based, natural-origin or chlorine-containing solvents.

These and other objects of the present invention have been attained by the present inventors' discovery of a method for preventing asphalt and tar from sticking to paving equipment, comprising contacting the surfaces with a dilution of a concentrated solution by spraying the diluted concentrate on the equipment prior to contacting the equipment with asphalt or tar, said spraying equipment to include, but not be limited to:

1) a carbonator pump or other vaned, positive-displacement pump which produces a minimum flow of about one gallon per minute ("1 GPM") and 200–300 pounds per square inch ("psi") pressure; and associated electric motor to drive the pump,
2) a timer relay to control the pump and motor,
3) an induction/injection valve with a high induction capacity of as low as about a 10/1 dilution ratio, even with viscous concentrates,
4) a spray gun with an appropriately-sized nozzle, (or a spray bar and a multiplicity of nozzles) and
5) necessary tubing, fittings, connections, control buttons, a box to enclose the apparatus, as well as a pressure relief valve and/or bypass valve, freeze protection, a particulate-filtering screen or screens, a solenoid to prevent non-pumped release of the release coating as optional ancillary devices.

DESCRIPTION OF THE INVENTION

This invention relates to a method of preventing tar and asphalt from sticking to paving equipment. The method comprises coating a paving equipment surface by spraying it with a release agent, 2) adding or contacting tar or asphalt to the equipment or otherwise handling or using the asphalt, and 3) if transportation or movement of the asphalt or tar is the desired purpose of utilizing the paving equipment, separating the asphalt from the equipment by releasing it at its point of intended use or otherwise releasing the asphalt or tar or related material from the paving equipment.

More particularly, the invention relates to utilizing a device to automate the water dilution of a concentrate, preferably comprising a fatty acid amide or mixture of fatty acid amides, a fatty acid neutralized with an alkanolamine, and optionally a solvent or solvents, of a type(s) that does (do) not dissolve asphalt. However, other types of concentrates could conceivably be used with the instant invention, a method which utilizes the following components:

1) a carbonator pump or other graphite-vaned, positive-displacement pump which produces a minimum flow of about one gallon per minute ("1 GPM") and 250–300 pounds per square inch ("psi") pressure; and associated electric motor to drive the pump,
2) a timer relay to control the pump and motor,
3) an induction/injection valve with a high induction capacity of as low as about a 10/1 dilution ratio, even when pumping viscous liquids,
4) a spray gun with an appropriately-sized nozzle, (or a spray bar and a multiplicity of nozzles) and
5) necessary tubing, fittings, connections, control buttons, a box to enclose the apparatus, as well as a pressure relief valve and/or bypass valve, freeze protection, a particulate-filtering screen or screens, a solenoid to prevent non-pumped release of the release coating as optional ancillary devices.

Examples of the carbonator pumps utilized in the instant invention include, but are not limited to, vane-type positive-displacement pumps by PROCON Products, a division of Roehlen Industries, in Murfreesboro, Tenn. Typically, a Series 1, up to potentially a Series 6 type of pump can be used. Other pumps capable of producing a minimum of approximately 1 GPM at 250–300 psi could conceivably work, but this kind of pump has high reliability and durability, and has the added advantage of not being overly expensive, and so it is the preferred embodiment.

An example of the type of relay that is useful in the instant invention include, but is not limited to, a JCK-24 type of relay by the Square D Company, which utilizes a momentary contact input to start an adjustable timed relay, with the timing range adjustable from about 2 seconds to about 1.5 minutes. The relay is capable of operating up to a 10-amp inductive load. Time length adjustment is made by turning a knob on the relay, and the relay fits into a base, making field replacement of the relay relatively easy.

Another example of the type of relay that finds utility in the instant invention is a CT-2-A20/M time cube relay system by Turck Inc., of Minneapolis, Minn. This is also a multi-component system, having a base, a separate timing mechanism, and the actual relay that controls the load is in a third module, which is relatively inexpensive and easily field replaceable.

Those skilled in the art will recognize that other timing relays and/or relay combinations would work, but they must be able to start and run a motor sized large enough to drive the desired pump. The major minimum requirements of the relay are that it have a reproducible timing range which includes the timeframe of 1–2 minutes minimum, the capability to start and run an appropriately-sized motor, on the order of ⅓ horse power minimum, be robust, easily field-replaceable, and relatively inexpensive.

An example of the induction/injection valve with a high induction capacity includes, but is not limited to, a "C Series" injector by Dema Engineering Company, of Saint Louis, Mo. In a preferred embodiment, a typical such injector might be a 200CS brass injector, fitted with a stainless-steel high-induction kit. This injector valve has the capacity to inject as much as about 0.1 gallon concentrate per gallon of water flow at about 200 psi. Other injector valves may also fulfill the requirements of the instant invention, but these are the preferred embodiment.

An example of a solenoid valve that finds utility in the instant invention is a ⅜" normally-closed, 110V solenoid valve manufactured by the Automatic Switch Company, with a required differential operating pressure range of 5–300 psi. Other similar solenoid valves may also fulfill the requirements of the instant invention, but this kind is a preferred embodiment.

An example of the spray gun and appropriately-sized nozzle is an Admiral Pump 1000 industrial spray gun, with a TP 6505 LP nozzle and associated hardware. This combination gives a good spray pattern with the above pump/injector valve, without causing undue back pressure. Other nozzle/spray gun combinations are effective in this invention, and one skilled in the art will realize that each combination of pump, injector, solenoid valve, etc. will require some potential adjustments in the nozzle selection.

In another embodiment, it may be advantageous to combine one or more to make an apparatus that can spray through multiple nozzles at once, so as to more rapidly coat a truck bed, for example.

BRIEF DESCRIPTION OF THE DRAWINGS

A schematic diagram of the apparatus utilized in this example is in FIG. 1.

EXAMPLE

Figure 1:
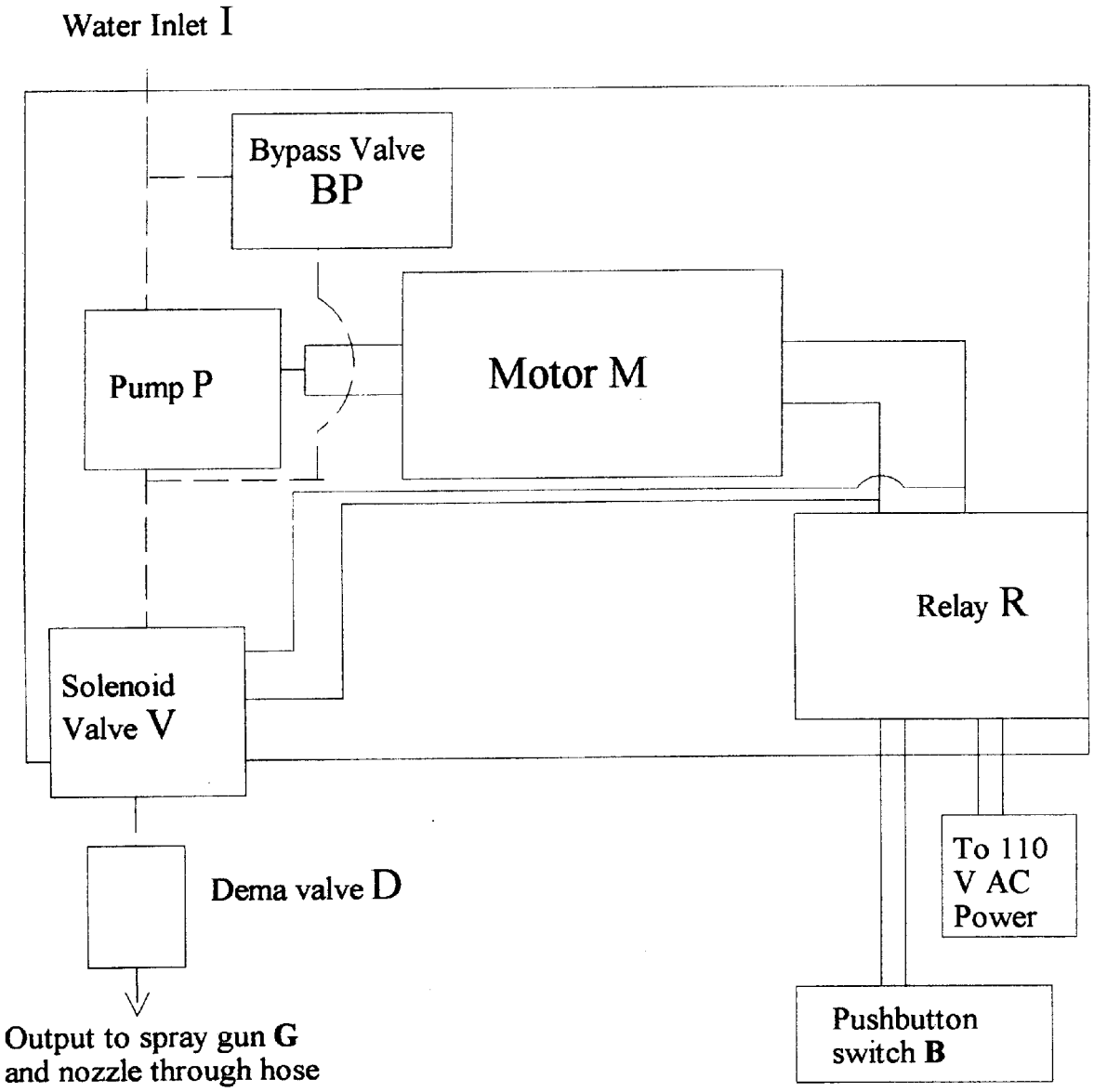

In the drawing, hatched lines connecting components indicate that water flows through that part of the system, and solid lines connecting components indicate that electricity flows through that part of the system. Lines with semi-circular portions in them, located where one line crosses another line in the drawing, represent locations where of necessity the lines cross in the drawing, but it is to be understood that there is no physical connection between the corresponding actual tubing and/or wiring in the actual device.

A delivery device was assembled using the following components:

a steel enclosure box, a Series 1, 70 GPM vane-type positive-displacement pump by PROCON Products a ⅓ HP electric motor manufactured by General Electric Company, with coupling clamp for coupling it to the pump, JCK-24 8-pin relay by the Square D Company with an associated relay base and wiring as appropriate to operate the electric pump and solenoid valve using the relay and connect to supplying motive power, A dust-tight, rain-tight pushbutton and wiring to the relay, 200CS brass injector with a high-induction kit, from the Dema Engineering Company, ⅜" normally-closed, 110V solenoid valve manufactured by the Automatic Switch Company, Admiral Pump 1000 industrial spray gun, with a Spraying Systems TP 6505 LP nozzle and associated hardware, an adjustable 0–300 psi pressure relief valve in a special loop back to the pump inlet, appropriate fittings, including rubber hoses to connect the pump directly or indirectly to the solenoid and supplying water and the pressure-relief bypass system, and to direct the water through the solenoid valve, then the 200 CS injector, then to the spray gun through a pressure-washer hose.

The apparatus was set up on an experimental basis at an asphalt plant, and utilized to dilute and spray a concentrate made according to U.S. Pat. No. 6,126,757. The resultant spray had a good pattern, was able to coat asphalt delivery truck beds within less than two minutes, and left a lubricious, persistent film evenly distributed on the truck beds, that prevented asphalt from sticking to them, even if the film dried out prior to loading the asphalt.

The water enters the water inlet I, goes through the pump P, driven by motor M, exits the pump and goes through the bypass valve BP and back into the pump inlet, or through the solenoid valve V, then the injection valve D, and through pressure hose to the spray gun G with attached nozzle. The relay R is attached to a regular 110 Volt electric source, and has a pushbutton momentary contact switch B, and is also attached to the pump P and solenoid valve V, both of which turn on simultaneously when the pushbutton B is pushed, for a time period which is adjustable on relay R.

What is claimed is:

1. A method for preventing asphalt and tar from sticking to paving equipment, consisting essentially of:

1) diluting a concentrate with about three to about 50 parts water to one part concentrate, 2) contemporaneously with the dilution step, spraying the diluted concentrate on the equipment prior to its coming in contact with asphalt or tar, then 3) contacting the coated equipment with asphalt or tar, then 4) releasing the asphalt or tar from the equipment, wherein the spraying is accomplished using an apparatus consisting essentially of I. a single pump and associated electric motor to drive the pump, said pump being a vaned, positive-displacement pump producing a minimum flow of about one gallon per minute at 200–300 pounds per square inch ("psi") pressure, II. a timer relay to control the pump and motor, III. an induction/injection valve with a high induction capacity yielding the mix of concentrate and water, IV. a spray gun with an appropriately-sized nozzle or spray bar with multiple nozzles, and V. necessary tubings, fittings, connections, control buttons, a box to enclose the apparatus, and optionally, ancillary devices selected from the group consisting of pressure relief valves, freeze protection, particulate-filtering screens, and a solenoid valve to prevent non-pumped release of the diluted concentrate.

2. The method of claim 1 wherein the pump is a carbonator pump.

3. The method of claim 1, wherein the apparatus does contain a solenoid valve to prevent non-pumped flow.

4. The method of claim 1, wherein the apparatus does not contain a solenoid valve to prevent non-pumped flow.

5. The method of claim 1, wherein the freeze protection is provided for the wetted components and/or particle filtration on the water inlet line.

* * * * *